United States Patent [19]

Ruey-Jang et al.

[11] Patent Number: 5,037,541

[45] Date of Patent: Aug. 6, 1991

[54] SANITARY DEVICE FOR SEWERAGE CHANNEL

[76] Inventors: Shiau Ruey-Jang, No. 10, Lane 48, Sec. 2, Chung Shan N. Rd.; Wu Teng-Tai, 5-1 Fl., No. 1, Alley 18, Lane 38, Min Chuan E. Rd., both of Taipei, Taiwan

[21] Appl. No.: 530,707

[22] Filed: May 30, 1990

[51] Int. Cl.[5] ..... E03F 5/06

[52] U.S. Cl. ..... 210/141; 210/155; 210/165; 210/203; 210/238; 210/498

[58] Field of Search ..... 210/155, 141, 162–165, 210/201, 238, 335, 498, 764, 916, 85, 97, 138, 202, 203, 206; 404/2

[56] References Cited

U.S. PATENT DOCUMENTS

| | | | |
|---|---|---|---|
| 122,209 | 12/1871 | Ashman et al. | 210/163 |
| 1,972,513 | 9/1934 | Drehmann | 210/165 |
| 4,093,551 | 6/1978 | Paabo et al. | 210/201 |
| 4,800,907 | 1/1989 | Giehl et al. | 210/164 |

FOREIGN PATENT DOCUMENTS

| | | | |
|---|---|---|---|
| 125643 | 11/1984 | European Pat. Off. | 210/163 |
| 71639 | of 1893 | Fed. Rep. of Germany | 210/163 |
| 2824616 | 12/1979 | Fed. Rep. of Germany | 210/164 |
| 2544255 | 4/1977 | United Kingdom | 210/163 |

*Primary Examiner*—Robert A. Dawson
*Assistant Examiner*—Joseph Drodge
*Attorney, Agent, or Firm*—Browdy and Neimark

[57] ABSTRACT

A sanitary device for a sewerage channel with an openable grating includes a bottom plate and four side walls which together define a space therebetween for accommodating several filtering plates for filtering dirt or the like contained in the rain water which drains into the sewerage channel through the sanitary device. Each of the four side walls has several apertures for passage of rain water to the sewerage channel. A first disinfecting container containing volatile disinfectant, such as mothballs, for cleaning the air inside the sewerage channel is attached to the side walls of the sanitary device. A hollow cylindrical tank is provided on an upper side of the bottom plate and extends upwards for receiving a second disinfecting container containing liquid disinfectant.

4 Claims, 2 Drawing Sheets

SANITARY DEVICE FOR SEWERAGE CHANNEL

BACKGROUND OF THE INVENTION

The present invention relates to a sanitary device for a sewerage channel with an openable grating for catchment of rain water or the like, particularly to a sanitary device equipped with a plurality of filtering plates, and with both volatile and liquid disinfectant for sanitizing the sewerage channel.

Generally, drains opening into sewerage channels are provided in gutters on both sides of roads for drainage of rain water or the like. The gutter usually has a concrete cover and is provided with a manhole cover which allows a worker to pass through to clean the sewerage channel. The gutter is also provided with a grating at suitable section of the concrete cover for catchment of rain water or the like.

Nevertheless, sand, dirt, and the like are drained into the sewerage channel with the rain water through the gaps in the grating and become slags which block the sewerage channel. Furthermore, trash, garbage and the like can very easily to be carried into the sewerage channel via the gaps of the grating further aggravating the blockage problem of the sewer and making the sewerage channel become the breeding ground for mice, mosquitoes and cockroaches and other vermin.

Because of this, many subsequent procedures are needed to sanitize the sewerage channel: mice must be caught by means of lures, the blocked sewerage channel must be periodically cleaned, and also periodically be sprayed with liquid disinfectant. However, these subsequent sanitizing procedures is uneconomical.

The present invention provides a sanitary device to obviate the aforementioned problems.

SUMMARY OF THE INVENTION

The present invention provides a sanitary device for a sewerage channel with an openable grating for catchment of rain water. The sewerage channel is covered by a concrete cover or the like. An opening is formed on the concrete cover for receiving the grating for catchment of rain water. A rectangular supporting flange extends horizontally from a rectangular peripheral side surface of the opening of the concrete cover.

The sanitary device comprises a bottom plate and four side walls which together define a space therebetween for accommodating a plurality of filtering plates each comprising a mesh for filtering dirt or the like from the rain water which drains through the sanitary device into the sewerage channel. Each of the four side walls of the sanitary device has a plurality of apertures for passage of rain water to the sewerage channel. A rectangular flange is formed on an upper margin of the sanitary device and extends horizontally for retaining the sanitary device on the rectangular supporting flange provided below the grating.

At least one of the four side walls is provided with a receiving means at an outer surface thereof. The receiving means has a chamber for accommodating a first disinfecting container containing volatile disinfectant, such as mothballs, for cleaning the air inside the sewerage channel via volatilization of the volatile disinfectant. A substantially cylindrical hollow tank is provided on an upper side of the bottom plate and extends upwardly for receiving a second disinfecting container containing liquid disinfectant. An actuating means is provided on a top surface of the second disinfecting container such that an actuation of the actuating means causes a pre-set quantity of liquid disinfectant to be injected into the sewerage channel through an outlet formed on a bottom surface of the second disinfecting container and a hole formed on the bottom plate within the cylindrical hollow tank.

The filtering plates are provided in the space of the sanitary device such that the size of the holes in the mesh of a lower filtering plate is smaller than the size of the holes in the mesh of an upper filtering plate.

It is an object of the present invention to provide a sanitary device having a plurality of filtering device to filter dirt, dust or the like contained in the rain water which drains into the sewerage channel.

It is another object of the present invention to provide a sanitary device having a tank for receiving liquid disinfectant so as to sanitize the sewerage channel.

It is still another object of the present invention to provide a sanitary device equipped with volatile disinfectant to sanitize the air inside the sewerage channel.

These and additional object, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
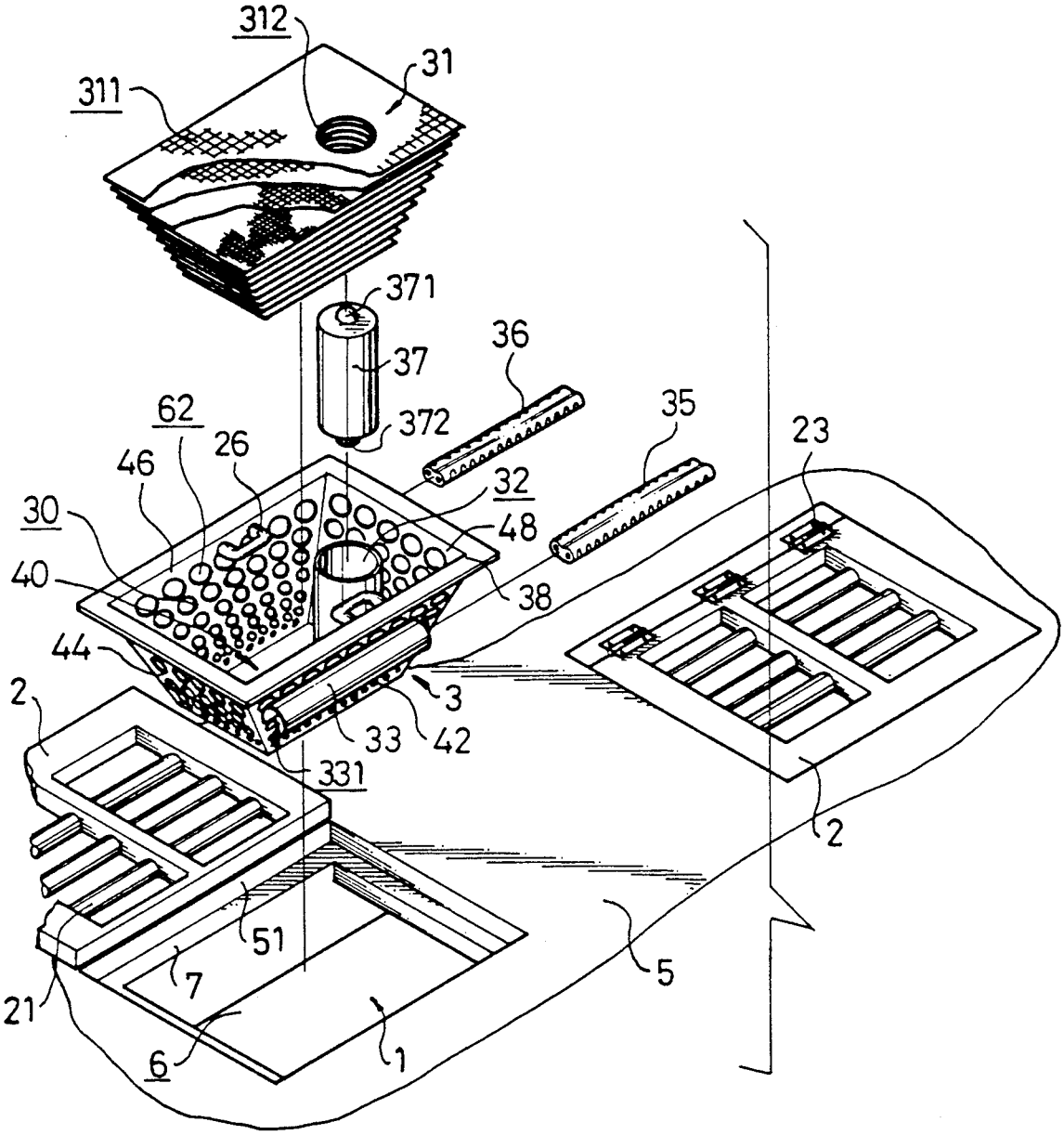
FIG. 1 is an exploded perspective view of a sanitary device for a sewerage channel with an openable grating in accordance with the present invention.
Figure 2:
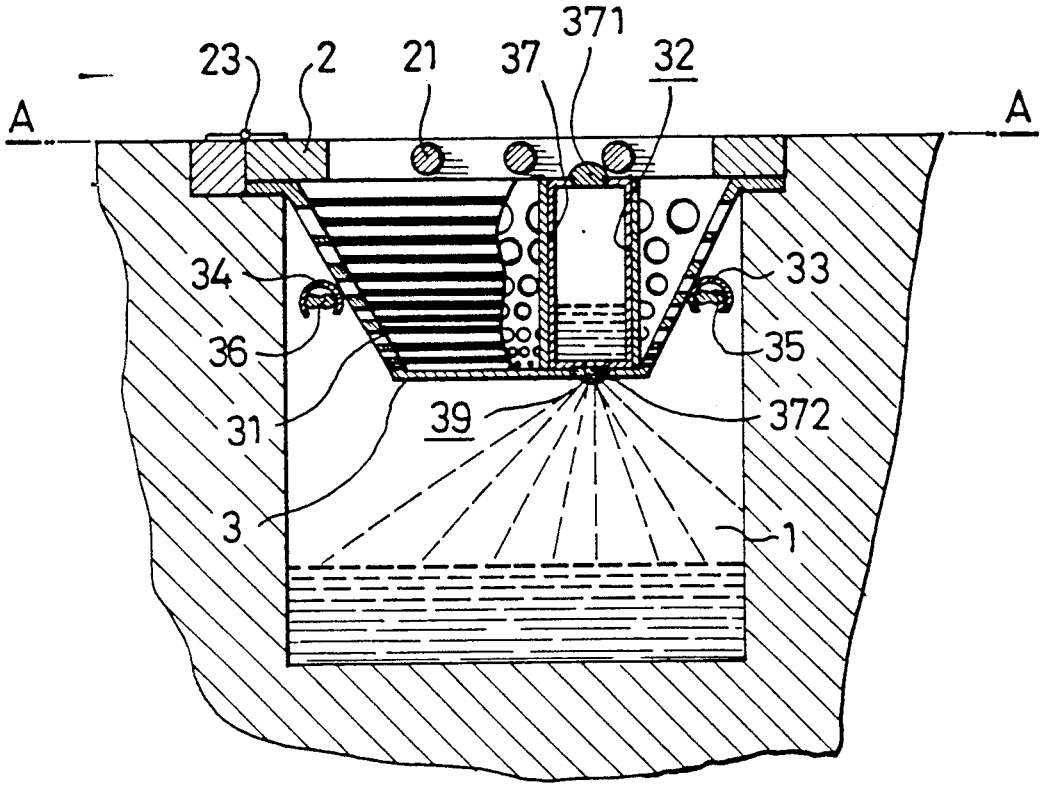
FIG. 2 is a cross-sectional view of the sanitary device according to the present invention, wherein the sanitary device has been installed below the grating of the sewerage channel and the line A—A is the ground level.

Referring to FIGS. 1 and 2, a sewerage channel 1 is usually covered by a concrete cover 5 and an opening 6 is formed on the concrete cover 5 at suitable position for catchment of rain water or the like. A grating 2 is hinged to the concrete cover 5 by hinges 23 and partially shields the opening 6 by the bars 21 thereon which prevent large trash or garbage from entering into the sewerage channel and therein causing the blockage of the sewerage channel.

A rectangular supporting flange 7 extends horizontally from a rectangular peripheral side surface 51 of the opening 6 of the concrete cover 5 for supporting the grating 2.

The sanitary device 3 according to the present invention comprises a bottom plate 40 and four side walls 42, 44, 46 and 48 which together define a space 30 therebetween for accommodating a plurality of filtering plates 31. Each filtering plate 31 comprises a mesh for filtering dirt or the like contained in the rain water which drains into the sewerage channel 1 through the sanitary device 3. The filtering plates 31 are provided in the space 30 such that the size of the holes 311 in the mesh of a lower filtering plate is smaller than the size of the holes 311 in the mesh of an upper filtering plate. Each filtering plate 31 has a through hole 312 for the passage therethrough of a hollow cylindrical tank 32 which will be hereinafter illustrated in detail. Each of the four side walls 42, 44, 46 and 48 has a plurality of apertures 62 for passage of rain water to the sewerage channel 1.

A rectangular flange 38 is formed on an upper margin of the sanitary device 3 and extends horizontally for retaining the sanitary device 3 on the supporting flange 7 provided below the grating 2. At least one of the four side walls 42, 44, 46, 48 is provided with a receiving means 33, 34 at an outer surface thereof. The receiving means 33, 34 has a chamber 331 for accommodating a first disinfecting container 35, 36 containing volatile disinfectant, such as mothballs, for cleaning the air inside the sewerage channel 1 via volatilization of the volatile disinfectant.

A substantially cylindrical hollow tank 32 is provided on an upper side of the bottom plate and extends upwardly for receiving a second disinfecting container 37 containing liquid disinfectant. A hole 39 is formed on the bottom plate 40 within the hollow cylindrical tank 32 (see FIG. 2). An actuating means 371 is provided on a top surface of the second disinfecting container 37 and an outlet 372 is formed on a bottom surface of the second disinfecting container 37. Upon an actuation of the actuating means 371, a pre-set quantity of liquid disinfectant is injected into the sewerage channel 1 through the outlet 372 and the hole 39 on the bottom plate 40. The outlet 372 can be a sprayer head so as to spray the liquid disinfectant over a wider area.

Two handgrips 26 are oppositely provided adjacent to an upper margin of two opposed inner surfaces of the four side walls. Therefore, an worker can easily take out the sanitary device and replace the first and second disinfecting containers 35, 36 and 37 whenever they run out of liquid or volatile disinfectant.

According to the above description it is appreciated that the present invention provides three types of sanitation for the sewerage channel. Firstly, trash and garbage of a large size or dirt or the like contained in the rain water which flows into the the sewerage channel through the sanitary device can not enter the sewerage channel because of the filtering plates. The filtered rain water flows into the sewerage channel via the apertures provided on the side wall of the sanitary device, Secondly, the volatile disinfectant cleans the air inside the sewerage channel and therefore prevents the sewerage channel from becoming malodorous. Thirdly, the liquid disinfectant can disinfect the rain water in the sewerage channel. Accordingly, a sewerage channel equipped with the sanitary device can be maintained in a sanitary state with very little effort.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims:

I claim:

1. A sanitary device for a sewerage channel with an openable grating for catchment, said sewerage channel being covered by a concrete cover, an opening being formed on said concrete cover for receiving said grating for catchment of water, a rectangular supporting flange extending horizontally from a rectangular peripheral side surface of said opening of an concrete cover, a sanitary device comprising a bottom plate and four side walls which together define a space therebetween for accommodating a plurality of filtering plates each comprising a mesh for filtering water which is draining into a sewerage channel through said sanitary device, each of said four side walls having a plurality of apertures for passage of water to said sewerage channel, a rectangular flange being formed on an upper margin of said sanitary device and extending horizontally for retaining a sanitary device on said supporting flange, at least one of said four side walls being provided with a receiving means at an outer surface thereof, said receiving means having a chamber means for accommodating a first disinfecting container, for cleaning the air inside said sewerage channel via volatilization of a volatile disinfectant, a substantially hollow cylindrical tank being provided on an upper side of said bottom plate and extending upwardly and receiving a second disinfecting container, an actuating means being provided on a top surface of said second disinfecting container and means for injecting a pre-set quantity of liquid disinfectant, in response to actuation of said actuating means into said sewerage channel through an outlet formed on a bottom surface of said second disinfecting container and a hole formed on said bottom plate .

2. The sanitary device as claimed in claim 1, wherein two handgrips are oppositely provided adjacent to an upper margin of two opposed inner surfaces of said four side walls.

3. The sanitary device as claimed in claim 1, wherein said filtering plates are provided in said space such that the size of the holes in said mesh of a lower filtering plate is smaller than the size of the holes in said mesh of an upper filtering plate.

4. The sanitary device as claimed in claim 3, wherein each said filtering plate has a through hole for the passing therethrough of said hollow cylindrical tank.

* * * * *